US011795759B2

(12) United States Patent
Church et al.

(10) Patent No.: US 11,795,759 B2
(45) Date of Patent: Oct. 24, 2023

(54) RAIL FOR AN ARCHITECTURAL COVERING

(71) Applicant: Hunter Douglas Inc., Pearl River, NY (US)

(72) Inventors: Coty Church, Westminster, CO (US); Patrick Foley, Evergreen, CO (US); Paul F. Josephson, Firestone, CO (US)

(73) Assignee: Hunter Douglas Inc., Pearl River, NY (US)

( * ) Notice: Subject to any disclaimer, the term of this patent is extended or adjusted under 35 U.S.C. 154(b) by 671 days.

(21) Appl. No.: 16/542,626

(22) Filed: Aug. 16, 2019

(65) Prior Publication Data

US 2019/0368268 A1 Dec. 5, 2019

Related U.S. Application Data

(62) Division of application No. 15/046,940, filed on Feb. 18, 2016, now Pat. No. 10,392,859.

(51) Int. Cl.

| | |
|---|---|
| ***E06B 9/38*** | (2006.01) |
| ***E06B 9/322*** | (2006.01) |
| ***E06B 9/262*** | (2006.01) |
| ***E06B 9/326*** | (2006.01) |
| ***E06B 9/24*** | (2006.01) |
| ***E06B 9/266*** | (2006.01) |

(52) U.S. Cl.

CPC ..... *E06B 9/322* (2013.01); *E06B 9/24* (2013.01); *E06B 9/262* (2013.01); *E06B 9/266* (2013.01); *E06B 9/326* (2013.01); *E06B 9/38* (2013.01); *E06B 2009/2627* (2013.01)

(58) Field of Classification Search

CPC . E06B 9/322; E06B 9/24; E06B 9/262; E06B 9/266; E06B 9/326; E06B 9/38; E06B 9/388; E03B 2009/2627

See application file for complete search history.

(56) References Cited

U.S. PATENT DOCUMENTS

| | | | |
|---|---|---|---|
| 5,078,195 | A | 1/1992 | Schön |
| 6,059,004 | A | 5/2000 | Oskam |
| 6,095,222 | A | 8/2000 | Voss |

(Continued)

FOREIGN PATENT DOCUMENTS

| | | | |
|---|---|---|---|
| JP | 2015-105556 A | † | 6/2015 |
| JP | 2015105556 A | | 6/2015 |

(Continued)

OTHER PUBLICATIONS

Non-Final Office Action U.S. Appl. No. 16/542,626 dated Apr. 25, 2022.

(Continued)

*Primary Examiner* — Daniel P Cahn
*Assistant Examiner* — Jeremy C Ramsey
(74) *Attorney, Agent, or Firm* — Dority & Manning, P.A.

(57) ABSTRACT

A rail for an architectural cover no is provided. The rail may be associated with a shade material of a covering. An adjustment device may be positioned at least partially within the rail. A plurality of lift cords may be associated with the adjustment device. The adjustment device may adjust an effective length of each of the lift cords to adjust a position of the rail within an architectural opening.

14 Claims, 7 Drawing Sheets

(56) References Cited

U.S. PATENT DOCUMENTS

| | | | | |
|---|---|---|---|---|
| 6,550,522 | B1 | 4/2003 | Lennon et al. | |
| 6,758,258 | B1 | 7/2004 | Nien | |
| 6,796,360 | B2 | 9/2004 | Ferrie et al. | |
| 7,311,132 | B2 | 12/2007 | Corey et al. | |
| D605,885 | S | 12/2009 | Judkins | |
| 7,766,068 | B2 | 8/2010 | Andersen | |
| 7,832,450 | B2 | 11/2010 | Brace et al. | |
| 7,984,743 | B2 † | 7/2011 | Rossato | |
| 7,993,086 | B2 | 8/2011 | Kruse et al. | |
| D693,598 | S | 11/2013 | Strand | |
| 8,857,494 | B2 | 10/2014 | Kirby et al. | |
| 8,931,540 | B2 | 1/2015 | Filko | |
| 9,212,519 | B2 | 12/2015 | Vrooman | |
| 9,357,868 | B2 † | 6/2016 | Anderson | |
| 9,445,684 | B2 * | 9/2016 | Franssen | A47H 23/00 |
| 10,407,981 | B2 * | 9/2019 | Anderson | E06B 9/325 |
| 2004/0177933 | A1 | 9/2004 | Hillman et al. | |
| 2005/0224191 | A1 | 10/2005 | Nien | |
| 2006/0048904 | A1 † | 3/2006 | Gruner | |
| 2006/0130980 | A1 | 6/2006 | Gromotka et al. | |
| 2006/0169418 | A1 | 8/2006 | Gromotka et al. | |
| 2006/0243399 | A1 | 11/2006 | Nien et al. | |
| 2007/0089839 | A1 | 4/2007 | Collum et al. | |
| 2008/0038086 | A1 | 2/2008 | Dietz et al. | |
| 2008/0083508 | A1 | 4/2008 | Rossato | |
| 2008/0149279 | A1 | 6/2008 | Leighty et al. | |
| 2008/0173409 | A1 | 7/2008 | Robertson et al. | |
| 2009/0032203 | A1 | 2/2009 | Liang | |
| 2009/0038762 | A1 | 2/2009 | Hsieh | |
| 2010/0243589 | A1 * | 9/2010 | Truett | E06B 9/262 211/124 |
| 2011/0265963 | A1 | 11/2011 | Drew et al. | |
| 2012/0312486 | A1 | 12/2012 | Spray | |
| 2013/0333849 | A1 * | 12/2013 | Kirby | E06B 9/388 160/331 |
| 2014/0374034 | A1 | 12/2014 | Corey et al. | |
| 2015/0020980 | A1 | 1/2015 | Franssen | |
| 2015/0240558 | A1 | 8/2015 | Vrooman | |

FOREIGN PATENT DOCUMENTS

| | | | |
|---|---|---|---|
| TW | M416682 | U1 † | 11/2011 |
| TW | I482681 | B † | 5/2015 |

OTHER PUBLICATIONS

Canadian Office Action corresponding to Application No. 3014845 dated Mar. 22, 2023.

* cited by examiner
† cited by third party

RAIL FOR AN ARCHITECTURAL COVERING

CROSS-REFERENCE TO RELATED APPLICATIONS

The present application is a divisional of U.S. patent application Ser. No. 15/046,940, filed Feb. 18, 2016, the disclosure of which is hereby incorporated herein by reference in its entirety for all purposes.

TECHNICAL FIELD

The present disclosure relates generally to coverings for architectural openings, and more specifically to a rail for an architectural covering.

BACKGROUND

Coverings for architectural openings, such as windows, doorways, archways, and the like, have taken numerous forms for many years. Some coverings include a retractable shade material that is movable between an extended position and a retracted position. A movable rail typically is attached to the shade material to facilitate extension of the shade material across the opening and to maintain the shade material in a desired configuration. Some movable rails include means to adjust the vertical position of the movable rail within the architectural opening.

BRIEF SUMMARY

The present disclosure generally provides a rail for an architectural covering that offers improvements or an alternative to existing arrangements. The rail may be coupled to a shade material to facilitate movement of the shade material across an architectural opening. In a preferred embodiment, the rail includes an adjustment device to adjust the vertical drop and/or the horizontal leveling of the rail within the architectural opening. The adjustment device includes a plurality of adjustment mechanisms for side-by side adjusting of a plurality of lift cords associated with the adjustment device. The rail may be coupled to the shade material in a manner which hides the rail from view.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The accompanying drawings, which are incorporated into and constitute a part of the specification, illustrate embodiments of the present disclosure by way of illustration only and, together with the general description above and the detailed description below, serve to explain the principles of the present disclosure.

DETAILED DESCRIPTION

In accordance with various principles of the present disclosure, an adjustment device is coupled to a movable rail of an architectural covering to provide one or more enhanced methods of adjusting the vertical drop and/or the horizontal leveling of the rail within an architectural opening. In one embodiment, the adjustment device is coupled to a portion of the rail, such as an end portion, in a manner that permits operation of the adjustment device when the rail is associated with a shade material. For example, the adjustment device may be accessible from an end of the rail if the rail is otherwise inaccessible, such as if the rail is placed within a cell of a cellular-structured shade material. In one embodiment, the adjustment device dudes a plurality of parallel adjustment mechanisms. In such an embodiment, the adjustment mechanisms are adjusted side-by-side within the rail.

Figure 1:
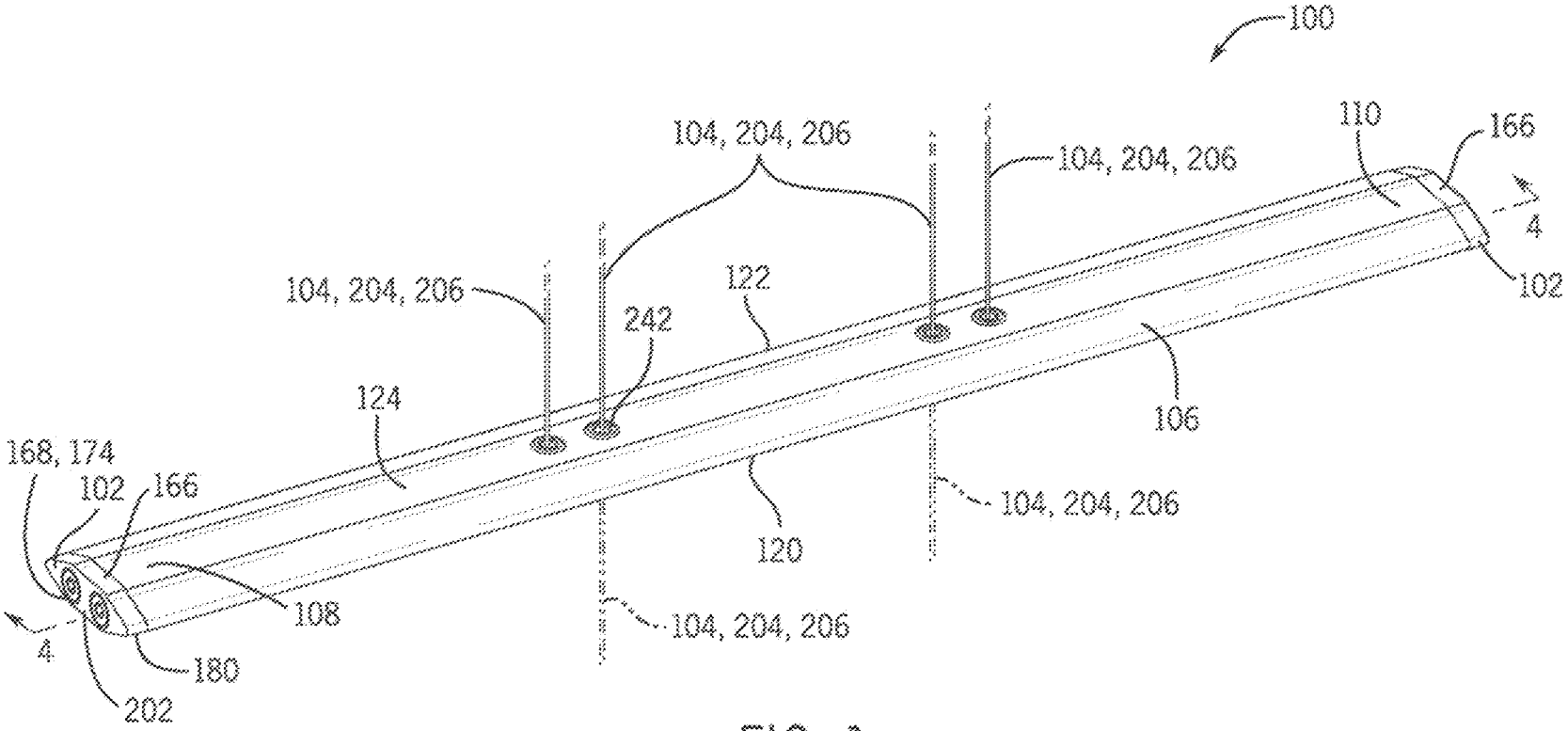
FIG. 1 is a front isometric view of a rail in accordance with an embodiment of the present disclosure.

FIG. 1 is a front isometric view of an illustrative embodiment of a rail 100 including an adjustment device 102 operable to adjust the vertical drop and/or the horizontal leveling of the rail 100 within an architectural opening, such as a window, doorway, archway, or the like. In some embodiments, at least one lift cord 104 may be associated with the rail 100 to move the rail 100 across the architectural opening, such as between extended and retracted positions as more fully explained below. In at least one embodiment, the lift cords 104 may be associated with the adjustment device 102 to adjust the vertical drop and/or the horizontal leveling of the rail 100. For example, the adjustment device 102 may be operable to adjust an effective length of each lift cord 104 (i.e., the length of each lift cord 104 from the rail 100 to an adjacent structure, such as a head rail or a bottom rail) to adjust the drop and/or level of the rail 100 within the architectural opening. As detailed below, use of the adjustment device 102 may move the rail 100 up or down substantially evenly to define a drop height of the rail 100 within the architectural opening. In this manner, the adjustment device 102 may facilitate adjustment of the drop of the rail 100 to accommodate architectural openings of different heights. Additionally or alternatively, use of the adjustment device 102 may move one end (e.g., a left end) of the rail 100 relative to an opposite end (e.g., a right end). In this manner, the adjustment. device 102 may facilitate horizontal leveling of the rail 100 within the architectural opening. In the embodiments described above, the adjustment device 10 may permit a user or customer to fine tune the vertical drop and/or the horizontal leveling of the rail 100 within an architectural opening as desired. As such, the adjustment device 102 may accommodate for slight imperfections in cord length between the various lift cords 104, whether existing at initial purchase or acquisition or through dimensional changes of the lift cords 104 over time. For example without limitation, variations in stresses (e.g., from heat, extended use, non-uniform loading of the rail 100, etc.) within the various lift cords 104 may lengthen or shorten the effective, length of each lift cord 104 in either a uniform or a non-uniform manner. In such embodiments, the adjustment device 102 may remedy the uniform and/or non-uniform changes in the effective lengths of the lift cords 104. Additionally or alternatively, the position of the rail 100 within an architectural opening may be adjusted via the adjustment device 102 based on user preferences or desires, such as to a desirable vertical position or horizontal orientation within the architectural opening.

Figure 2:
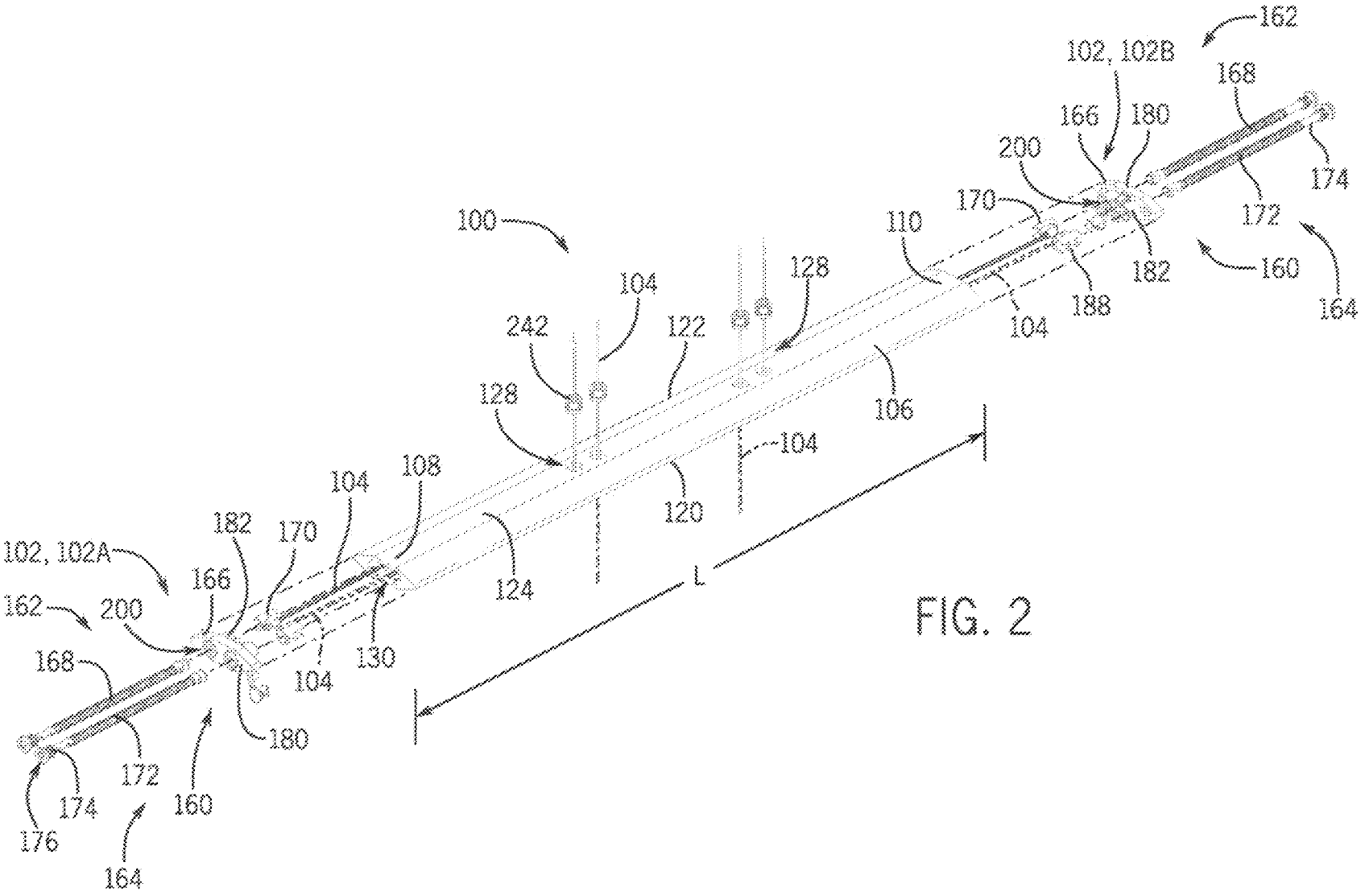
FIG. 2 is an exploded isometric view of the rail of FIG. 1 in accordance with an embodiment of the present disclosure.
Figure 3:
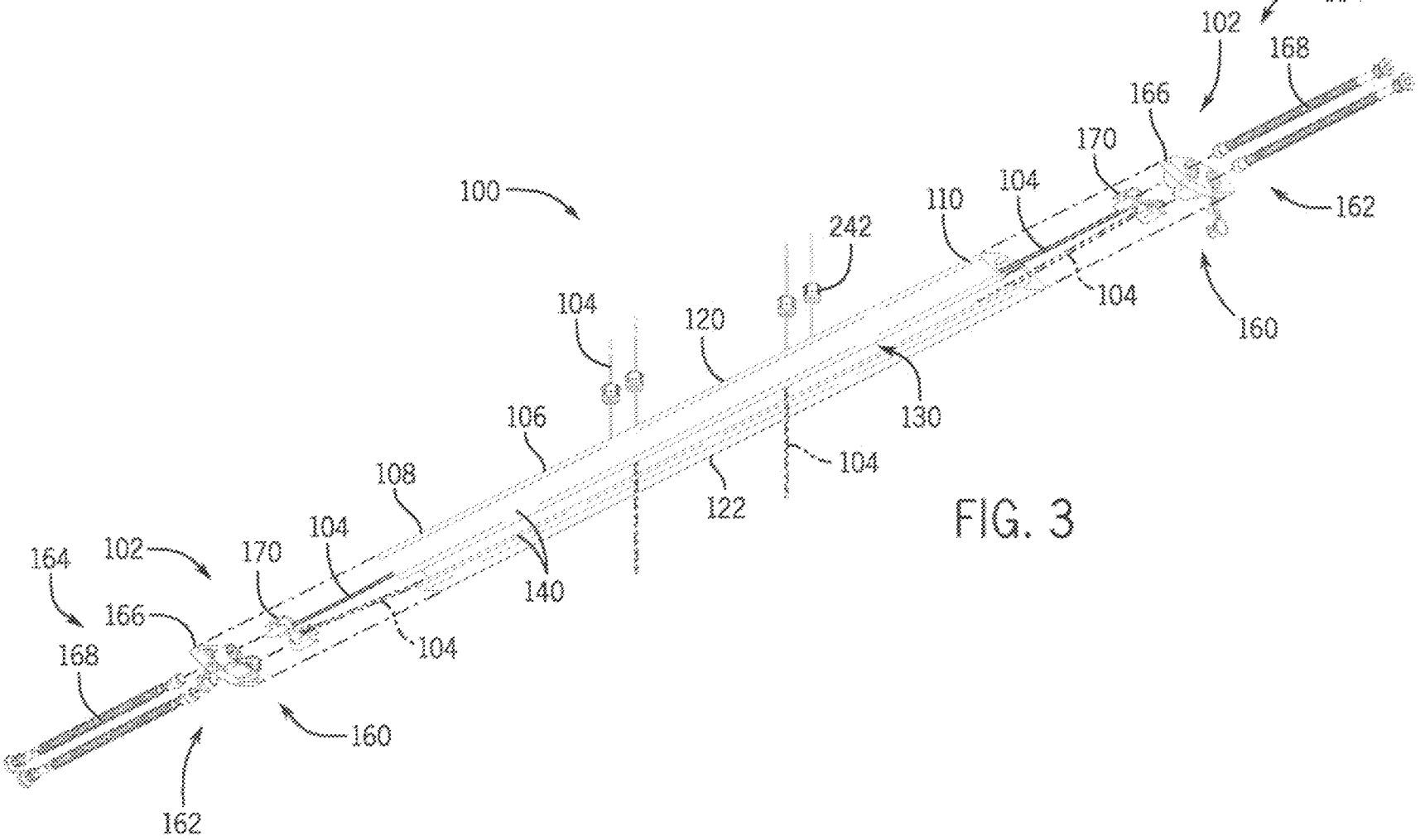
FIG. 3 is an additional exploded isometric view of the rail of FIG. 1 in accordance with an embodiment of the present disclosure.
Figure 4:
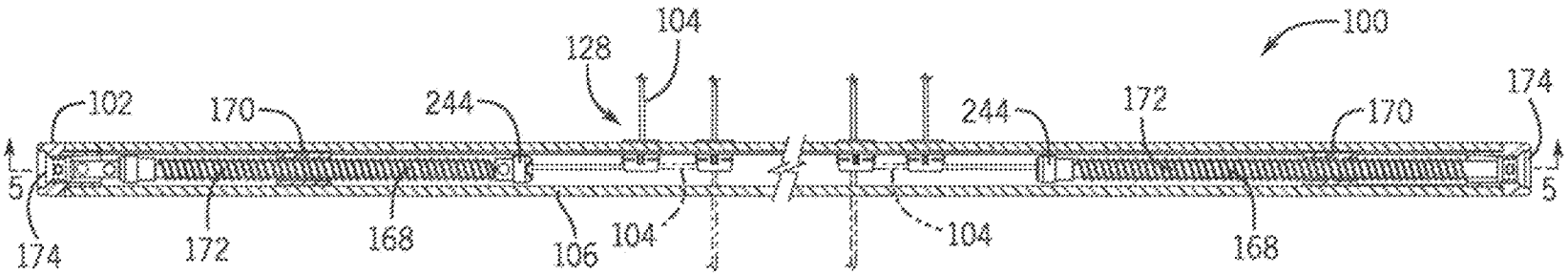
FIG. 4 is an enlarged, cross-sectional view of the rail of FIG. 1 taken along line 4-4 of FIG. 1 in accordance with an embodiment of the present disclosure.
Figure 6:
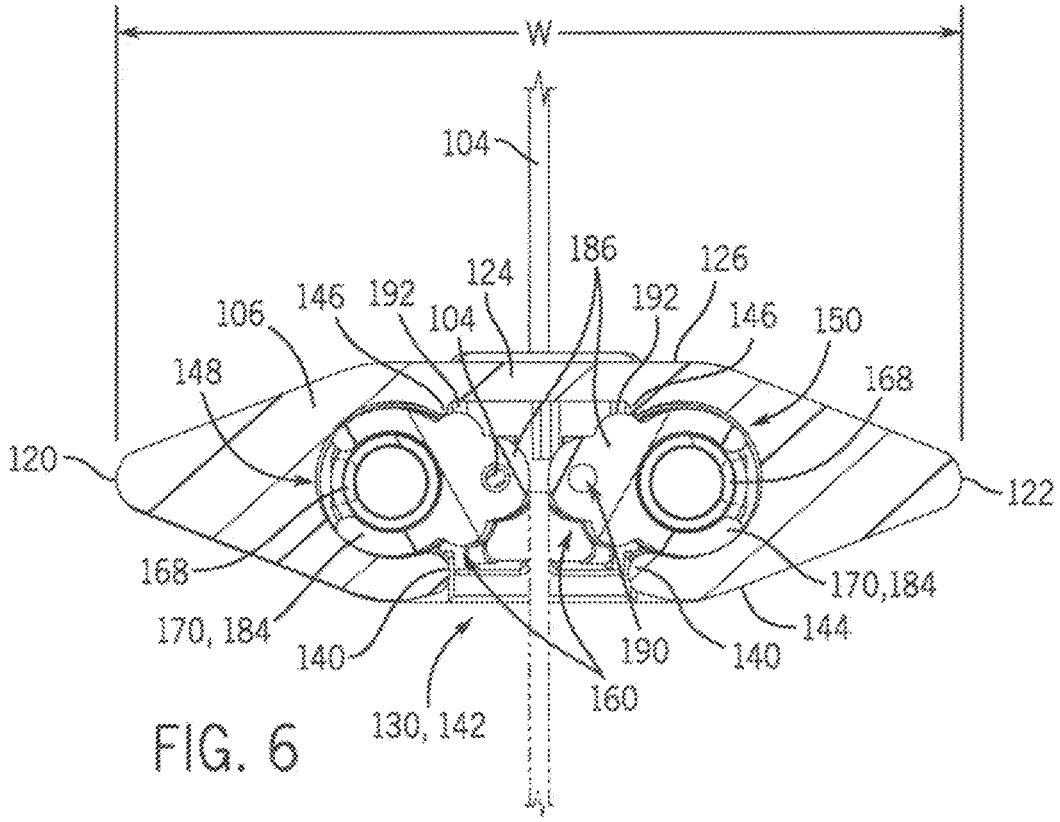
FIG. 6 is an enlarged, cross-sectional view of the rail of FIG. 1 taken along line 6-6 of FIG. 5 in accordance with an embodiment of the present disclosure.

Referring to FIGS. 1-3, the rail 100, which may be a middle rail or a bottom rail, may include an elongated rail member 106. In some embodiments, the rail member 106 may include opposing first and second ends 108, 110 and opposing front and rear longitudinal edges 120, 122. The first and second ends 108, 110 may define a longitudinal length L of the rail member 106 (see FIG. 2). In such embodiments, the front and rear longitudinal edges 120, 122 may define a transverse width W of the rail member 106 (see FIG. 6), the width W of the rail member 106 being smaller than its length L. As best seen in FIG. 6, the rail member 106 may include a bridge member 124 connected between the front and rear longitudinal edges 120, 122 to space the front and rear longitudinal edges 120, 122 apart from each other to define the width W of the rail member 106, for instance. As shown, the bridge member 124 may define an uppermost surface 126 of the rail member 106. In some embodiments, a plurality of apertures 128 may be defined within the bridge member 124 (see FIG. 2). In such embodiments, the lift cords 104 may pass through the apertures 128 to associate the rail 100 with an operating system operable to move the rail 100 across an architectural opening. As illustrated in FIGS. 2 and 4, one or more lift cords 104 may extend through one of the apertures 128 of the bridge member 124 and towards an adjustment device 102. As detailed below, the lift cords 104 may be coupled to a movable portion of the adjustment device 102 to facilitate adjustment of the effective lengths of the lift cords 104, for instance.

For the purposes described hereinafter, a channel 130 may be formed along at least a portion of the length L of the rail member 106 (e.g., the entirety of the length L) and defined by the bridge member 124 and the front and rear longitudinal edges 120, 122. As may be seen in FIG. 6, the rail member 106 may include longitudinally-extending, opposing edge portions 140 defining an opening 142 of the channel 130 within a surface such as a lowermost surface 144 of the rail member 106. In some embodiments, a plurality of ridges 146 may extend longitudinally within the channel 130 from the bridge member 124 towards the opposing edge portions 140 to at least partially define a plurality of parallel paths (e.g., first and second paths 148, 150 longitudinally within the channel 130. In such embodiments, the opposing edge portions 140 may be positioned across the channel 130 opposite the ridges 146 to further define the first and second paths 148, 150. In such embodiments, each of the first and second paths 148, 150 may be substantially C-shaped cross-section, though other cross-section shapes are contemplated including round, polygonal, etc. In such embodiments, the first and second paths 148, 150 may be operable to hold a correspondingly-shaped portion of the adjustment device 102 therein. In some embodiments, the first and second paths 148, 150 may open towards each other such that the width of the channel 130 is greater than a distance between the opposing edge portions 140. As explained more fully below, the ridges 146 and/or the opposing edge portions 140 may act as guide members for at least a portion of the adjustment device 102 to translate within the channel 130 at least partially along the length L of the rail 100.

With continued reference to FIG. 6, the rail member 106 may be sized and shaped to incorporate necessary weight within the rail member 106. Such weighting of the rail member 106 may be desirable, for example, to counterbalance at least a portion of the forces tending to retract the rail 100 upwardly, such as in cordless shades. For instance, the weighting of the rail member 106 may counterbalance retraction forces within the shade such that the rail 100 is held in place. In some embodiments, the front and rear longitudinal edges 120, 122 may include a material thickness greater than a material thickness of the bridge member 124. In such embodiments, added weight may be incorporated into the rail member 106 such that the rail member 106 includes a uniform weight distribution along the front and rear longitudinal edges 120, 122. In this manner, the rail member 106 itself may include sufficient weight without the need for adding supplemental weights to the rail member 106. Additionally or alternatively, the increased material thickness of the front and rear longitudinal edges 120, 122 may provide a balanced weight distribution from front-to-back. Such a configuration may be desirable to limit front-to-back tilting of the rail member 106, thus providing a desired aesthetic and/or functional, characteristic to the rail 100. To provide additional weight, supplemental weight members, which may be sized and shape to substantially match the shape of the channel 130, may be inserted or snapped into place within the channel 130. In such embodiments, the supplemental weight members may reside substantially within the profile of the rail 100 such that the weight members are not visually noticeable to a user or customer during operation.

Figure 5:
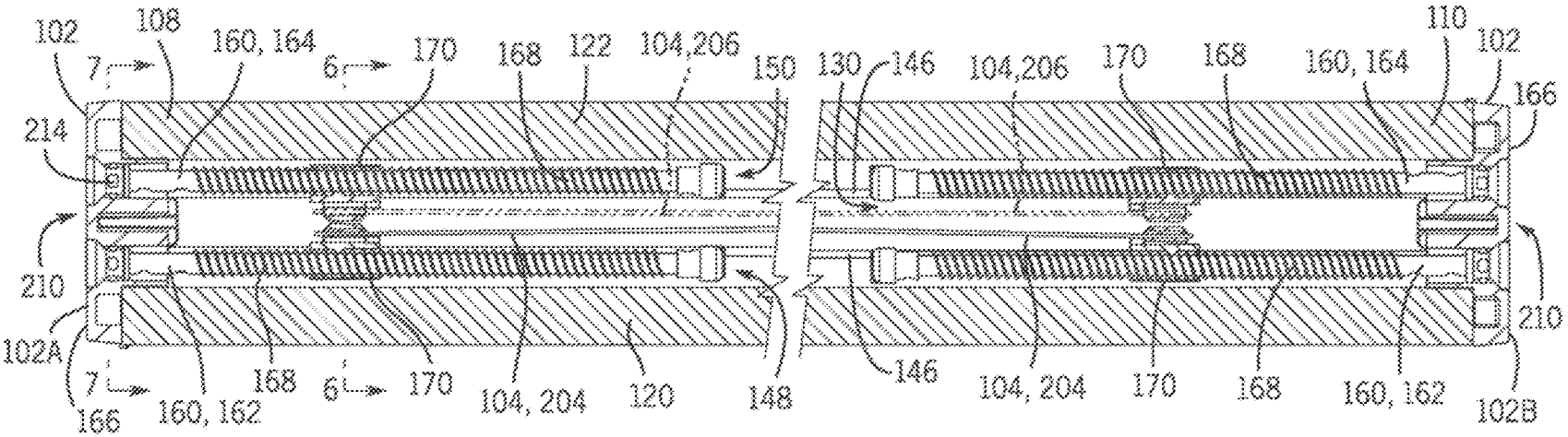
FIG. 5 is an enlarged, cross-sectional view of the rail of FIG. 1 taken along line 5-5 of FIG. 4 in accordance with an embodiment of the present disclosure.

Referring to FIGS. 2 and 3, the adjustment device 102 may be positioned at least partially within the channel 130 and adjacent an end (e.g., adjacent the first end 108, adjacent the second end 110, or adjacent both the first and second ends 108, 110) of the rail 100. In such embodiments, the adjustment device 102 may include a plurality of adjustment mechanisms 160 (e.g., first and second adjustment mechanisms 162, 164) for side-by-side adjusting of the lift cords 104 associated therewith within the channel 130 (see FIG. 5). As explained in detail below, each of the adjustment mechanisms 160 may operate along an axis substantially parallel to the length L of the rail 100 to adjust the effective lengths of the lift cords 104 associated thereto. In this manner, the adjustment mechanisms 160 may be substantially parallel to one another as best shown in FIG. 5. Referring to FIGS. 2 and 3, in one embodiment, the adjustment device 102 may include an end cap 166, at least one adjustment screw 168 (e.g., a plurality of adjustment screws 168) associated with the end cap 166, and at least one nut 170 (e.g., a plurality of nuts 170) each threadedly engaged with one of the adjustment screws 168. In such embodiments, each of the first and second adjustment mechanisms 162, 164 may be defined by an adjustment screw 168 and a nut 170. As illustrated, each adjustment screw 168 may include a threaded portion 172 and a head portion 174 defining a tool engagement profile 176. In one embodiment, the tool engagement profile 176 may be recessed within the head portion 174 of the adjustment screw 168 for receipt of a driving member (e.g., a hex key, screwdriver, etc.) therein.

With continued reference to FIGS. 2 and 3, the end cap 166, which may close the ends of the rail 100, may include a first portion 180 and a second portion 182 extending from the first portion 180. In some embodiments, each of the first and second portions 180, 182 may be sized and shaped to substantially match a portion of the rail 100. For example, the first portion 180, which may be referred to as an outer or exterior portion, may be sized and shape to substantially match the profile of the rail 100 to provide a blear or substantially seamless transition between the rail 100 and the end cap 168 (see FIG. 1). The second portion 182, which may be referred to as an inner or interior portion, may be sized and shape to substantially match the profile of the channel 130. In such embodiments, the second portion 182 of the end cap 166 may be inserted within the channel 130 at least to secure the end cap 166 to the end of the rail 100. Additionally or alternatively, the end cap 166 may be secured to the end of the rail 100 through fasteners, adhesive, heat or some welding, interference fit between the second portion 182 of the end cap 166 and the rail 100, a detent structure, or the like.

Referring to FIG. 6, each nut 170 may be slidably received within the channel 130 to facilitate adjustment of the effective lengths of the lift cords 104. As illustrated, each nut 170 may include first and second portions 184, 186. The first portion 184 may be arcuately-shaped in cross-section for slidable receipt within the first path 148 or the second path 150 of the channel 130. In some embodiments, the first portion 104 may be substantially C-shaped in crops-section to permit the but 170 to be snap-fitted onto one of the adjustment screws 168. In such embodiments, the first portion 184 of the nut 170 may include a thread 188 operable to engage the threaded portion 172 of the adjustment screws 168 (see FIG. 2). As explained more fully below, rotation of the nut 170 about the adjustment screw 168 may translate the nut 170 along a length of the adjustment screw 168 towards or away from the end cap 166 depending on the direction of rotation of the adjustment screws 168. For example, rotation of the adjustment screws 168 in a first direction (e.g., clockwise in FIG. 6) may move the nut 170 in a first direction (e.g., away from the end cap 166). Similarly, rotation of the adjustment screws 168 in a second direction (e.g., counterclockwise in FIG. 6) may move the nut 170 in a second direction (e.g., towards the end cap 166). It will be appreciated that other manners of actuating the adjustment mechanisms 160 are within the scope of the present disclosure.

Referring still to FIG. 6, the second portion 186 of the nut 170 may be operable to engage at least one lift cord 104. For example, the second portion 186 of the nut 170 may include a bore 190 defined therethrough for receipt of the lift cord 104 therein. In such embodiments, an end of the lift cord 104 may be threaded through the bore 190. Ins one embodiment, the lift cord 104 is terminated in a knot, though other coupling mechanisms may be used to effectively secure the end of the lift cord 104 to the second portion 186 of the nut 170, including fasteners, crimping, adhesive, or the like. The bore 190 may be sized to closely match the size of the lift cord 104 such that the knot limits removal of the rift cord 104 from the bore 190. Though one embodiment of the connection structure between the lift cord 104 and the adjustment mechanism 160 is described above, in some embodiments, the connection between the lift cord 104 and the adjustment device 102 may be different depending on whether the adjustment device 102 is operable to adjust only the drop height of the rail 100 or whether the adjustment device 102 is operable to level the rail 100 in addition to adjusting its drop height. For example, to adjust only the drop of the rail 100, each lift cord 104 may be connected to a single adjustment mechanism 160, such as in the manner described above. To both level and adjust the drop height of the rail 100 each lift cord 104 is connected to a separate adjustment mechanism 160, such as in the manner described above. In such embodiments, the adjustment mechanisms 160 may be moved equally to adjust the drop of the rail 100 or may be moved separately to adjust the level of the rail 100 within the architectural opening as more fully explained below.

Referring back to FIG. 6, additionally or alternatively, in some embodiments, the second portion 186 of each nut 170 may be operable to align the first portion 184 within the channel 130 (e.g., within one of the first and second paths 148, 150). For example, the second portion 166 of the nut 170 may include a plurality of bumps 192. In such embodiments, the bumps 192 are operable to engage the ridges 146 and the edge portions 140 of the rail member 106 to rotationally align the nut 170 within the channel 130 (e.g., within one of the first and second paths 148, 150). When the nut 170 is positioned within one of the first and second paths 148, 150, the bumps 192 limit rotational movement of the nut 170 relative to the rail 100 such that rotational movement of an associated adjustment screw 168 translates the nut 170 longitudinally within the first path 148 or the second path 150 in which it is received. As illustrated in FIG. 6, the size and shape of the nut 170 (e.g., the size and shape of the second portion 186 of the nut 170) may position each lift cord 104 along the length L of the rail 100 such as adjacent a midline of the rail 100 between the front and rear edges 120, 122.

In the embodiments described herein, rotational movement of the adjustment screws 168 relative to the end cap 166 may adjust the adjustment mechanisms 160 to adjust the effective lengths of the lift cords 104 to alter the vertical drop and/or the horizontal leveling of the rail 100. For example, at least one aperture 200 (e.g., a plurality of apertures 200) may be defined though the end cap 166 (e.g., through the first and second portions 180, 182 of the end cap 166) along the longitudinal length L of the rail 100 (see FIG. 2). In such embodiments, each adjustment screw 168 may be rotatably received at least partially within an associated aperture 200. Once positioned within the apertures 200, the head portion 174 of adjustment screw 168 may sit substantially flush with an exterior surface 202 of the end cap 166 (see FIGS. 1 and 9). In some embodiments, the apertures 200 may be defined within the end cap 166 to position the adjustment screws 168 side-by-side along a length of the channel 130. For example, as best illustrated in FIG. 5, the adjustment screws 168 may extend substantially parallel to each other within the first and second paths 148, 150 of the channel 130. In such embodiments, each of the adjustment screws 168 may rotate about an axis substantially parallel to the length L of the rail 100. In this manner, rotational movement of the adjustment screws 168 may translate the nuts 170 side-by-side within the first and second paths 148, 150 channel 130 and along at least a portion of the length L of the rail 100. Because the lift cords 104 are coupled to the nuts 170, translational movement of the nuts 170 within the channel 130 towards or away from the end cap 166 adjusts the effective lengths of the lift cords 104. For instance, translational movement of the nuts 170 towards the end cap 166 may shorten the effective length of the lift cords 104 attached thereto. In like manner, translational movement of the nuts 170 away from the end cap 166 may lengthen the effective length of the lifts cords attached thereto. Because the nuts 170 move side-by-side within the channel 130, the nuts 170 may move in different directions relative to one another or, additionally or alternatively, at least one nut 170 may remain stationary while at least another nut 170 moves towards or away from the end cap 166.

In the various embodiments described herein, a user may actuate the adjustment device 102 to adjust the level and/or drop of the rail 100 across an architectural opening. For example, each adjustment device 102 may be associated with first and second lift cords 204, 206. In such embodiments, the first adjustment mechanism 162 of the adjustment device 102 may adjust the effective length of the first lift cord 204, and the second adjustment mechanism 164 of the adjustment device 102 may adjust the effective length of the second lift cord 206. In some embodiments, the first and second lift cords 204, 206 may be associated with the first and second ends 108, 110 of the rail 100. In Such embodiments, use of a single adjustment device 102 may adjust both the level and drop of the rail 100. For example, to adjust the drop of the rail 100, a user may rotate the adjustment screws 168 of the first and second adjustment mechanisms 162, 164 an approximately equal amount to translate the nuts 170 of the first and second adjustment mechanisms 162, 164 an approximately equal distance towards or away from the end cap 166. Additionally or alternatively, to level the rail 100, a user may actuate one of the first and second adjustment mechanisms 162, 164 to raise or lower one of the first and second ends 108, 110 relative to the other of the first and second ends 108, 110 by adjusting the effective length of one of the first and second lilt cords 204, 206.

In some embodiments, the first and second lifts cords 204, 206 may be associated with the rail 100 and an adjacent rail member (e.g., a bottom rail). For example, the first lift cord 204 may be associated with the first end 108 of the rail 100, and the second lift cord 206 may be associated with the bottom rail. In such embodiments, use of a single adjustment device 102 may adjust the positioning of both the rail 100 and the bottom rail. For example, rotation of the adjustment screw 168 of the first adjustment mechanism 162 may lengthen or shorten the effective length of the first lift cord 204 to level the rail 100 in the same manner as described above. In such embodiments, rotation of the adjustment screw 168 of the second adjustment mechanism 164 may lengthen or shorten the effective length of the second lift cord 206 to level and/or adjust the vertical drop of the bottom rail.

In embodiments wherein adjustability of more than two lift cords 104 is desired, two adjustment devices 102 may be associated with the rail 100. For example, as shown in FIGS. 2 and 5, a first adjustment device 102A may be associated with the first end 108 of the rail 100, and a second adjustment device 102B may be associated with the second end 110 of the rail 100. In such embodiments, the first and second adjustment devices 102A, 102B may be operable to adjust at least four lift cords 104 independently from one another. Additionally or alternatively, the first adjustment device 102A may be associated with the first end 108 of the rail 100 to adjust only the first lift cord 204, and the second adjustment device 102B may be associated with the second end 110 of the rail 100 to adjust only the second lift cord 206 (see FIG. 9). Though described with reference to the various examples above, it is contemplated that the adjustment device 102 may be associated with an end of the rail 100 to adjust the positioning of at least the rail 100 within an architectural opening in substantially any manner.

Figure 7:
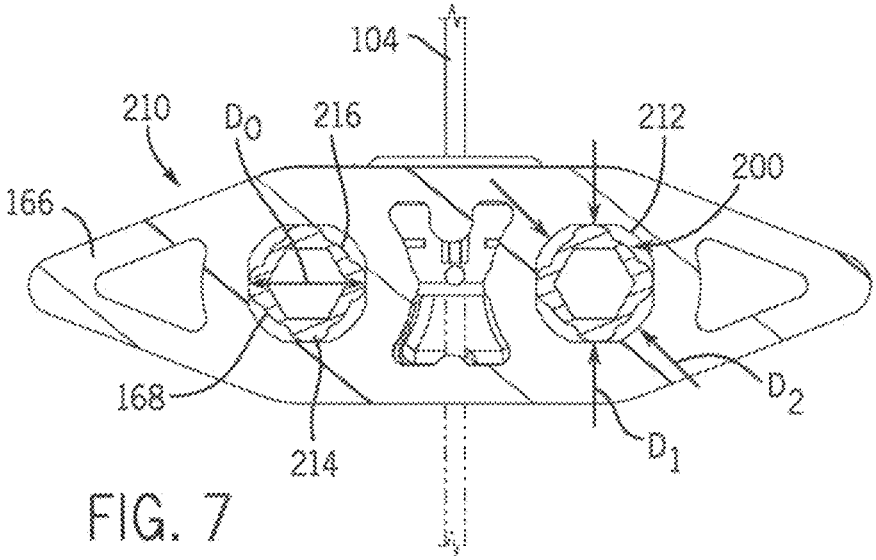
FIG. 7 is an enlarged, cross-sectional view of the rail of FIG. 1 taken along line 7-7 of FIG. 5 in accordance with an embodiment of the present disclosure.

With reference to FIGS. 5 and 7, the adjustment device 102 in one embodiment may include a detent structure 210 formed between the end cap 166 and each adjustment screw 168 to limit rotational movement of each adjustment screw 168 within an associated aperture 200 of the end cap 166. For example without limitation, each aperture 200 within the end cap 166 may be defined by a faceted surface 212 (see FIG. 7). The faceted surface 212 may define at least first and second inner diameters $D_1$, $D_2$ of each aperture 200. One of the first and second inner diameters $D_1$, $D_2$ may be greater than the other of the first and second inner diameters $D_1$, $D_2$. For example, in the illustrative embodiment of FIG. 7, the first inner diameter $D_1$ is greater than the second inner diameter $D_2$ of each aperture 200 for the purposes described below. In some embodiments, each of the adjustment screws 168 may include a plurality of resilient tabs 214 extending radially from an outer surface 216 of the adjustment screw 168 (e.g., adjacent the head portion 174). In such embodiments, the tabs 214 may define an outer diameter $D_0$ of the adjustment screw 168. To limit rotational movement of the adjustment screw 168 within the aperture 200 of the end cap 166, the outer diameter $D_0$ of the adjustment screw 168 may be greater than one of the first and second inner diameters $D_1$, $D_2$ (e.g., the second inner diameter $D_2$). In such embodiments, the detent structure 210 is operable to limit rotational movement of the adjustment screws 168 within the apertures 200 absent use of a driving member (e.g., a hex key, screwdriver, socket wrench, etc.) providing sufficient rotational force overcome the interference fit between the facet surface 212 and the tabs 214.

Figure 8:
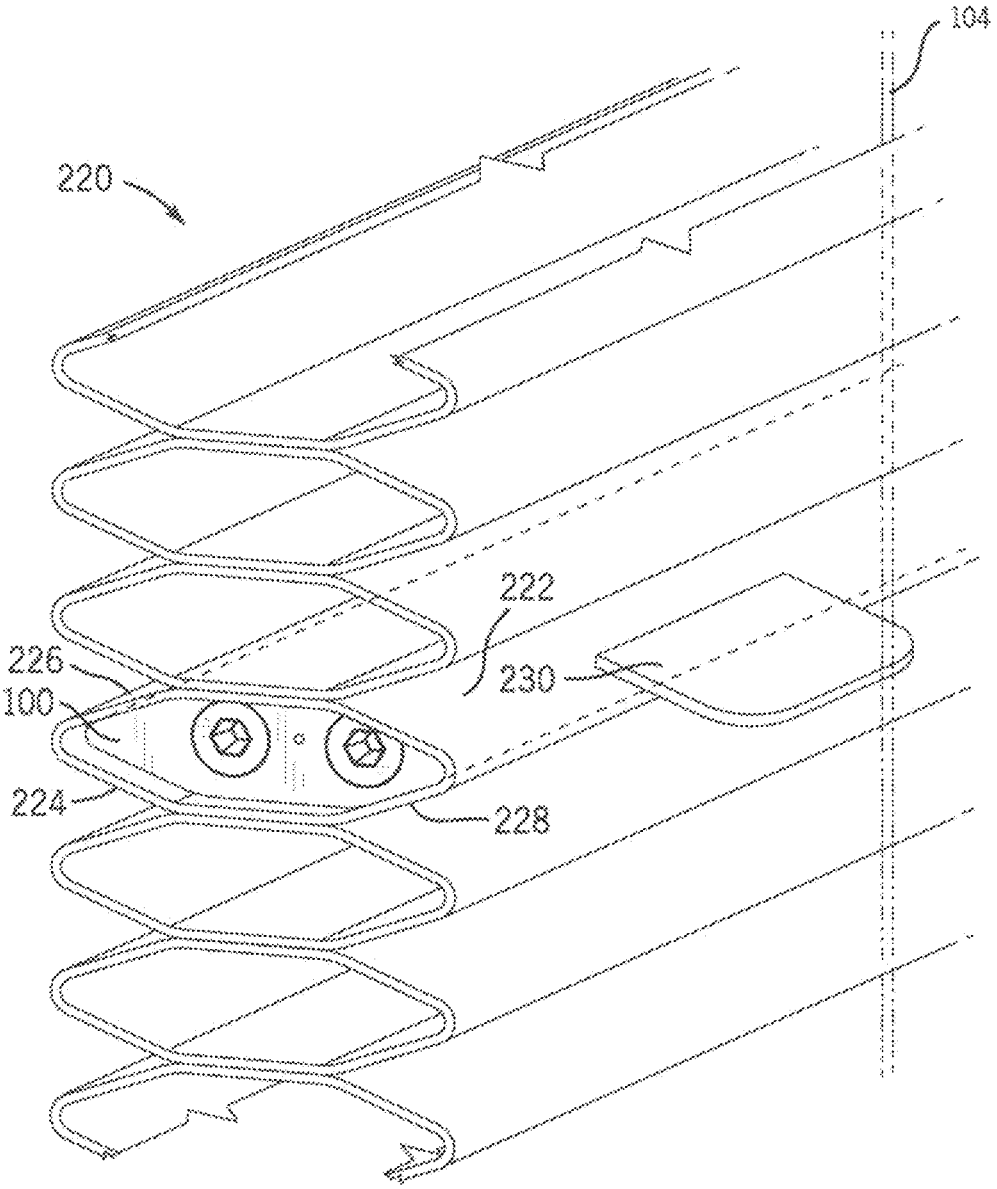
FIG. 8 is a side elevation view of the rail of FIG. 1 associated with a shade material in accordance with an embodiment of the present disclosure.

Referring now to FIG. 8, the rail 100 may be associated with a covering 220 of an architectural opening. For instance, the rail 100 may be associated with a shade material 222 to open and close the shade material 222 as the rail 100 is retracted and extended, respectively, across the architectural opening. As illustrated, in one embodiment, the shade material 222 may include a cellular structure having a plurality of cells 224. In such embodiments, the rail 100 may be inserted within one of the cells 224 of the shade material 222 such that the rail 100 may be considered hidden. In some embodiments, the rail 100 may be sized and shaped to substantially match the shape of the cell 224 in which it is inserted. For example, the rail 100 may be substantially hexagonal-shaped to closely match the shape of a partially closed cell 224 of a honeycomb shade. In one embodiment, the rail 100 may be shaped to closely mimic top and bottom halves 226, 228 of the cell 224. In this manner, the rail 100 may provide increased support for the stack of shade material 222 positioned below the rail 100 compared to other arrangements. In the embodiments herein, the adjustment device 102 may be accessible from the side of the rail 100 along the axial length of the cell 224. In this manner, the vertical drop and/or horizontal leveling of the rail 100 may be adjusted without removing the rail 100 from the cell 224. Additionally or alternatively, the present disclosure allows the vertical drop and/or horizontal leveling of the rail 100 to be adjusted while the shade material 222 is substantially closed without substantially opening the cell 224).

With continued reference to FIG. 8, a handle 230 may be secured to the rail 100 to facilitate movement of the rail 100 across an architectural opening. In embodiments wherein the rail 100 is received within one of the cells 224 of the shade material 222, the handle 230 may be secured to the rail 100 through the shade material 222 (i.e., a portion of the shade material 222 may be positioned between the rail 100 and the handle 230). For example, the handle 230 may be secured to the rail 100 via mechanical fasteners (e.g., rivets, screws, bolts, etc.), snap features, adhesive, magnets or any other attachment method. In some embodiments, the fabric of the shade material 222 may be sandwiched tightly between the rail 100 and the handle 230. However, in some embodiments, spacers may be positioned between the rail 100 and the handle 230 to allow the fabric of the shade material 222 to float between the rail 100 and the handle 230. In each of the embodiments described above, the area where the attachment method passes through the fabric of the shade material 222 may be protected by a strip of material, which may be formed from plastic or fabric and may be flexible or rigid. The strip of material, which may be secured to the shade material 222 via adhesive, may be configured to hold the fabric in place. Additionally or alternatively, the strip of material may prevent fraying or unraveling of the fabric material due to holes or cuts in the fabric necessary to secure the handle 230 to the rail 100. In such embodiments, the strip of material may reduce the stress concentration within the portion of the shade material 222 adjacent the connection between the handle 230 and the rail 100. In this manner, the strip of material may be operable to reduce the likelihood of the shade material 222 tearing or otherwise distorting as a user raises or lowers the rail 100 via the handle 230.

Figure 9:
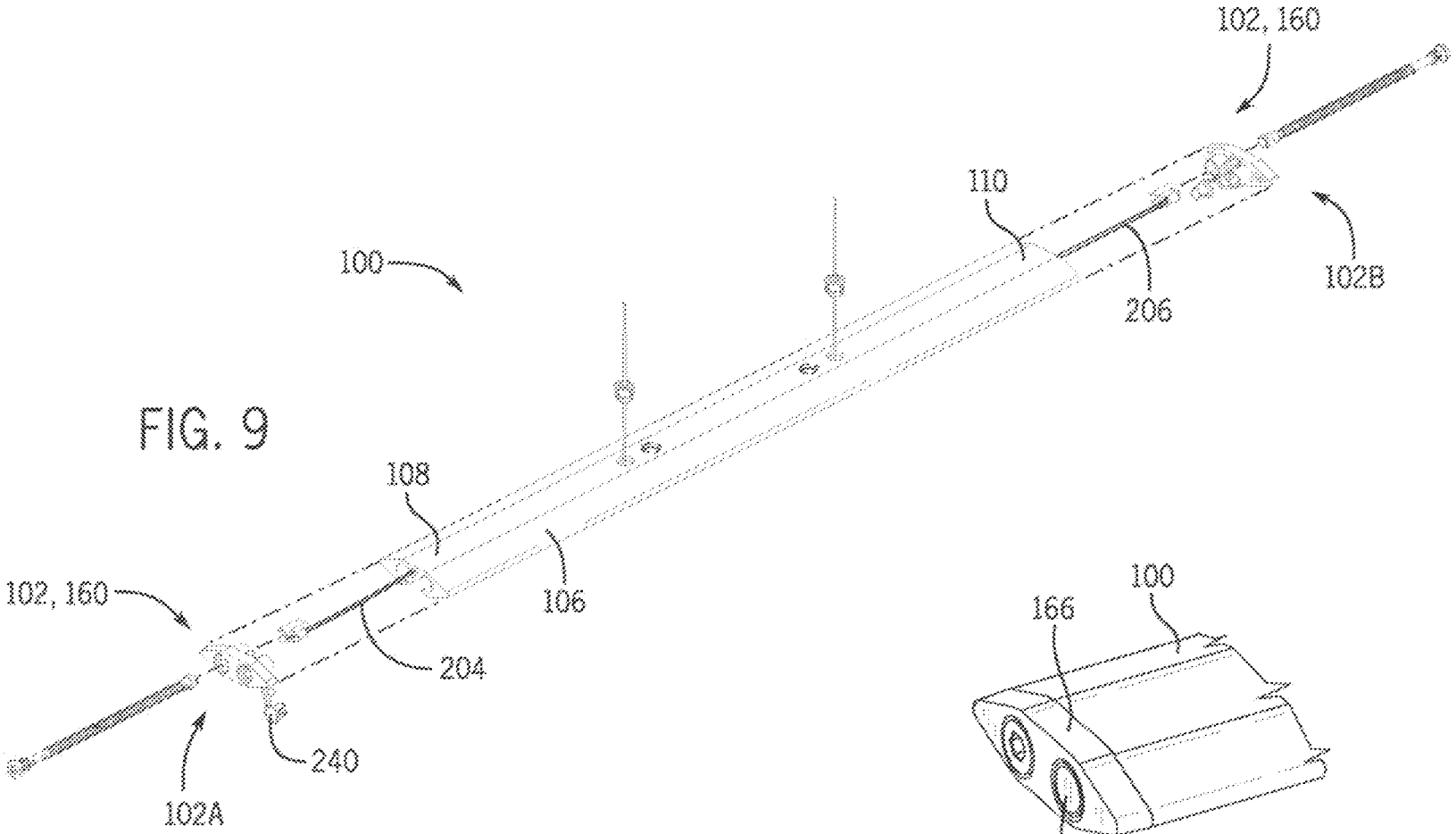
FIG. 9 is an exploded isometric view of additional rail in accordance with an embodiment of the present disclosure.
Figure 10:
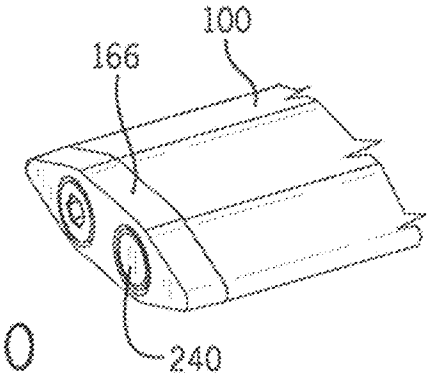
FIG. 10 is an enlarged fragmentary view of an end of the rail of FIG. 9 in accordance with an embodiment of the present disclosure.

Referring now to FIGS. 9 and 10, the rail 100 may include other features for convenience. For example, should only one of the parallel adjustment mechanisms 160 be utilized in some embodiments, a cap 240 may be received within the non-utilized aperture of the end cap 166. For convenience, the cap 240 may be shipped to a user or customer releasably attached to the end cap 166. As shown in FIGS. 1 and 2, each of the apertures 128 defined within the bridge member 124 may receive a grommet 242 through which the lift cords 104 slide. The grommets 242 may define the path, of the lift cords 104 through the rail 100 and, in some embodiments, may protect the lift cords 104 from sliding against sharp edges defined in the rail 100. Referring to FIG. 4, each of the adjustment screws 168 may include a terminal end portion 244 opposite the head portion 174. The terminal end portion 244 may include a diameter greater than that of the threaded portion 172 to prevent the out 170 from disengaging the adjustment screw 168 due to over-rotation of the adjustment screw 168 within the channel 130.

The rail 100 and the adjustment device 102 may be constructed of substantially any type of material. For example, the rail 100 and each of the components of the adjustment device 102 may be constructed or formed from natural and/or synthetic materials, including metals, ceramics, plastics, vinyl, and/or other suitable materials. Plastic materials may include thermoplastic material (self-reinforced or fiber-reinforced), ABS, polycarbonate, polypropylene, polystyrene, PVC, polyamide, or PTFE, among others. In some embodiments, the rail 100 may be formed of extruded aluminum or another thermoformable material. In some embodiments, the rail 100 may be a roll formed steel or another malleable material. The rail 100 and the adjustment device 102 may be built, formed, molded, or non-molded in any suitable manner, such as by plug molding, blow molding, injection molding, milling or the like.

The foregoing description has broad application. It should be appreciated that the concepts disclosed herein may apply to many types of shades, in addition to the shades described and depicted herein. Similarly, should be appreciated that the concepts disclosed herein may apply to many types of rails, in addition to the rail 100 described and depicted herein. For example, the concepts may apply equally to any type of covering having a rail movable across an architectural opening. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower upward, downward, left, right, lateral, longitudinal, front, back, top, bottom, above, below, vertical, horizontal radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not ended to connote importance or priority, but are used to distinguish one feature from another. The drawings are for purposes of illustration only and the dimensions, positions, order and relative sizes reflected in the drawings attached hereto may vary.

What is claimed is:

1. A movable rail for a covering for an architectural opening, the movable rail comprising:

an elongated rail member comprising:

opposing first and second ends defining a length of said rail member in a lengthwise direction of said rail member;

opposing front and rear longitudinal edges defining a width of said rail member in a widthwise direction of said rail member that is smaller than said length;

a bridge member connected between said front and rear longitudinal edges in the widthwise direction;

a channel formed along at least a portion of said length of said rail member, said channel including a central channel portion and first and second channel portions separated from each other by said central channel portion;

first and second longitudinal ridges extending from said bridge member within said channel; and first and second longitudinally-extending, opposing edge portions defining an opening of said channel that is positioned opposite said bridge member in a transverse direction of said rail member, the transverse direction extending perpendicular to the widthwise direction;

wherein said first and second opposed edge portions are spaced apart across said channel in the transverse direction from said first and second ridges to at least partially define said first and second channel portions of said channel relative to said central portion of said channel; and wherein the front longitudinal edge extends in the widthwise direction a first widthwise distance beyond the first channel portion and the rear longitudinal edge extends in the widthwise direction a second widthwise distance beyond the second channel portion to define a point of maximum width of the elongated rail member in the widthwise direction, the first widthwise distance being greater than a first width of the first channel portion in the widthwise direction and the second widthwise distance being greater than a second width of the second channel portion in the widthwise direction, the point of maximum width arranged: (1) in a common horizontal plane with the first and second channel portions; and (2) between the bridge member and the opening in the transverse direction.

2. The movable rail of claim 1, wherein said first and second channel portions define first and second parallel paths extending in the lengthwise direction along said channel.

3. The movable rail of claim 1, wherein each of said first and second channel portions is substantially C-shaped in cross-section.

4. The movable rail of claim 1, wherein said rail member is operable to be inserted within a cell of a shade, the shade comprising a cellular structure.

5. The movable rail of claim 1, further comprising a shade material in which said rail member is inserted.

6. The movable rail of claim 4, wherein said rail member includes a shape that substantially matches a shape of said cell.

7. The movable rail of claim 6, wherein said cellular structure comprises a honeycomb structure and said shape of said rail member substantially matches the shape of said honeycomb structure.

8. The movable rail of claim 1, further comprising an adjustment device positioned at least partially within said channel and adjacent one of said first and second ends of said rail member.

9. The movable rail of claim 1, wherein said front and rear longitudinal edges include a material thickness greater than a material thickness of said bridge member to provide additional weight to said elongated rail member.

10. The movable rail of claim 8, wherein said adjustment device is configured to adjust an effective length of at least one lift cord coupled to said adjustment device.

11. The movable rail of claim 8, wherein:

said adjustment device includes a first adjustment mechanism and a second adjustment mechanism;

said first adjustment mechanism extends in the lengthwise direction within said first channel portion and said second adjustment mechanism extends in the lengthwise direction within said second channel portion.

12. The movable rail of claim 11. wherein said first adjustment mechanism is separated from said second adjustment mechanism within said channel.

13. The movable rail of claim 11, wherein said first and second channel portions are configured to support said first and second adjustment mechanisms, respectively, relative to said central channel portion for separate movement along at least a. portion of the said rail member.

14. The movable rail of claim 11, wherein each of said first and second adjustment mechanisms is separately rotatable relative to said channel about a respective axis extending parallel to the lengthwise direction.

* * * * *